US007708430B2

(12) United States Patent
Shemitz et al.

(10) Patent No.: US 7,708,430 B2
(45) Date of Patent: May 4, 2010

(54) REFLECTOR-BAFFLE FOR LUMINAIRES

(75) Inventors: Sylvan R. Shemitz, Woodbridge, CT (US); Paul R. Ford, Orange, CT (US); Joseph R. Zaharewicz, Bethany, CT (US)

(73) Assignee: Sylvan R. Shemitz Designs, Incorporated, West Haven, CT (US)

( * ) Notice: Subject to any disclaimer, the term of this patent is extended or adjusted under 35 U.S.C. 154(b) by 0 days.

(21) Appl. No.: 12/172,600

(22) Filed: Jul. 14, 2008

(65) Prior Publication Data

US 2009/0097255 A1 Apr. 16, 2009

Related U.S. Application Data

(63) Continuation of application No. 11/346,515, filed on Feb. 2, 2006, now abandoned.

(60) Provisional application No. 60/650,058, filed on Feb. 4, 2005.

(51) Int. Cl.
*F21V 7/00* (2006.01)

(52) U.S. Cl. ..... 362/290; 362/291; 362/341; 362/296.01

(58) Field of Classification Search ..... 362/342, 362/290, 291, 341, 296.01
See application file for complete search history.

(56) References Cited

U.S. PATENT DOCUMENTS

| | | | | |
|---|---|---|---|---|
| 2,537,398 | A | 1/1951 | Dameral | |
| 5,412,551 | A | 5/1995 | Newell | |
| 5,758,954 | A * | 6/1998 | Holten et al. | 362/291 |
| 6,273,592 | B1 * | 8/2001 | Herst et al. | 362/342 |
| 6,305,824 | B1 | 10/2001 | Holten | |
| 6,443,598 | B1 | 9/2002 | Morgan | |
| 6,705,746 | B2 | 3/2004 | Perlo et al. | |
| 6,705,747 | B2 * | 3/2004 | Caferro et al. | 362/291 |
| 6,709,131 | B1 * | 3/2004 | Herst et al. | 362/223 |
| 2003/0095410 | A1 * | 5/2003 | Caferro et al. | 362/291 |

OTHER PUBLICATIONS

PCT Search Report—PCT/US06/04105.
Scientific Lighting Products, "PARASQUARE 3: High Efficiency Parabolic Louver," © 2002 ClearPages http://www.scientific-lighting.com/parabolicP3.htm.

* cited by examiner

*Primary Examiner*—Ali Alavi
(74) *Attorney, Agent, or Firm*—Cantor Colburn LLP

(57) ABSTRACT

An embodiment may comprise a baffle blade or blades, an article of manufacture, and/or a luminaire comprising: a blade member with a reflective top section.

29 Claims, 14 Drawing Sheets

REFLECTOR-BAFFLE FOR LUMINAIRES

CROSS REFERENCE TO RELATED APPLICATIONS

This application is a Continuation application of U.S. Ser. No. 11/346,515, filed Feb. 2, 2006, the contents of which are incorporated by reference herein in their entirety, which claims priority to U.S. provisional application 60/650,058 filed Feb. 4, 2005, the contents of which are also hereby incorporated herein by reference in their entirety.

BACKGROUND OF THE INVENTION

Directing light incident from a light fixture in a precise way while maintaining adequate shielding of the source presents a challenge. Louvers or baffles are typically used to direct light and to prevent direct viewing of the light source, for example, so a lamp is not in direct view of an observer's eyes.

As best seen in FIGS. 1*a* and 2, a traditional baffle consists of a series of parallel blades 1 placed under the light source 6 to obscure or prevent direct viewing of the light source 6 or to control brightness of the luminare 2. Baffle blades 1 have traditionally been designed in one of two ways, flat or parabolic.

As shown in FIG. 1A, a flat baffle blade 1 simply occludes, absorbs or disperses (see FIG. 1*b*) the light 7 that would otherwise be directed in an undesirable direction such as into an observer's eyes 8.

A parabolic baffle 9 has vertically orientated sides 10 designed to perform the dual function of shielding the light source 6 and reflecting the light 7 rather than absorbing the light 7 (FIG. 1*c*). A variation of the parabolic design is the "para-wedge" which has vertically orientated "sides" 10 and 10*a* that are both parabolic and wedge shaped as shown in FIG. 1*d*.

Note: for purposes of this patent application, applicants note that "side" is defined herein as a surface with a substantially vertical orientation as opposed to a "top" which is defined herein as a surface having a substantially horizontal orientation.

Thus, the efficiency and effectiveness of the prior art baffle blades 1 depends upon the surface finish of the baffle blades 1 as well as its shape. For example, the flat baffle blade 1 is thinner than the parabolic baffle blade 9 so it allows more light to propagate through the aperture; however, since the parabolic blades 9 typically have a specular finish, light that hits the side 10 of the baffle blade is reflected rather than absorbed.

Additionally, parabolic baffle blades 9 are typically constructed such that the upper most part of the baffle blades 9 are either folded over or "hollowed out" due to fabrication or cost considerations.

Thus, it would be advantageous to make use of the light 7 which strikes the top horizontally orientated section of the baffle blades that is otherwise scattered randomly or simply absorbed. As described in detail below, by designing a baffle blade in which the top surface is considered and designed as a useful reflecting surface, more light can be redirected into a chosen direction rather than letting it be absorbed or scattered randomly.

SUMMARY OF THE INVENTION

An embodiment may comprise a baffle blade for a luminaire comprising a blade member. The blade member comprising a reflective top section; and at least one side of the blade member; wherein the reflective top section has a reflective surface that has a substantially horizontal orientation in the luminaire; and wherein the sides of the blade member have a substantially vertical orientation in the luminaire; and wherein the reflective top section is structured so that light is directed from the reflective top section to a predetermined location.

An embodiment may also comprise an article of manufacture comprising: a blade member comprising: a reflective top section; and at least one side of the blade member; wherein the reflective top section has a reflective surface that has a substantially horizontal orientation in relation to the at least one side; and wherein the reflective top section is structured so that light is directed from the reflective top section to a predetermined location.

An embodiment may also comprise a luminaire comprising: a reflector; and at least one baffle blade having a reflective top section; wherein the reflective top section is structured so that light is reflected from the reflective top section to the reflector in order to redirect light towards a predetermined direction and to increase light output of the luminaire in a specific direction.

BRIEF DESCRIPTION OF THE DRAWINGS

The following descriptions should not be considered limiting in any way. With reference to the accompanying drawings, like elements are numbered alike.

DETAILED DESCRIPTION OF THE PREFERRED EMBODIMENTS

The following example is a luminaire used for lighting book stacks or aisles or other spaces which is enhanced by incorporating the baffle designs and baffle blade members of an embodiment of the invention. Additionally, custom or semi-custom applications are commonly ordered by customers such as lighting for specific merchant aisles. Thus, other configurations are also envisioned and intended to be covered by the attached claims.

Figure 11:
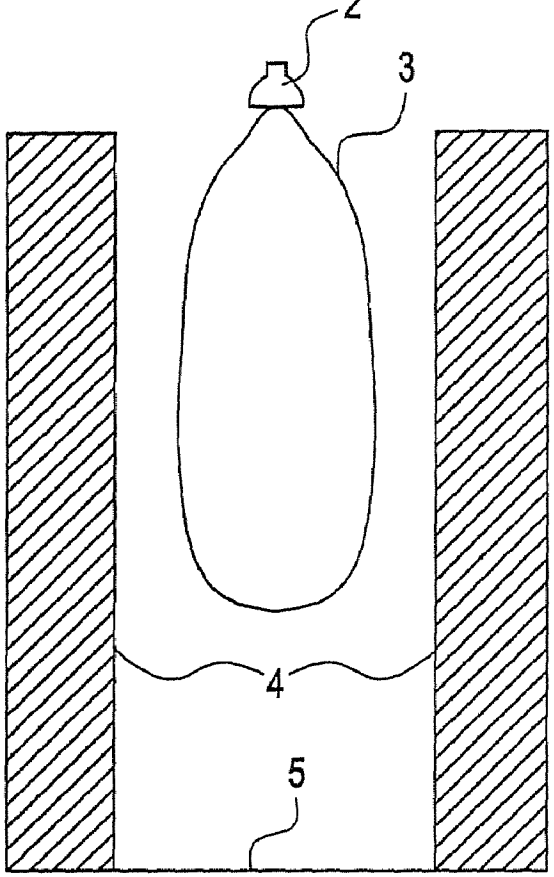
FIG. 11 PRIOR ART
FIG. 11 is a candlepower distribution curve (polar plot) of a prior art luminaire with a typical baffle. Most of the light is allowed to hit the floor between the shelving.
Figure 12A:
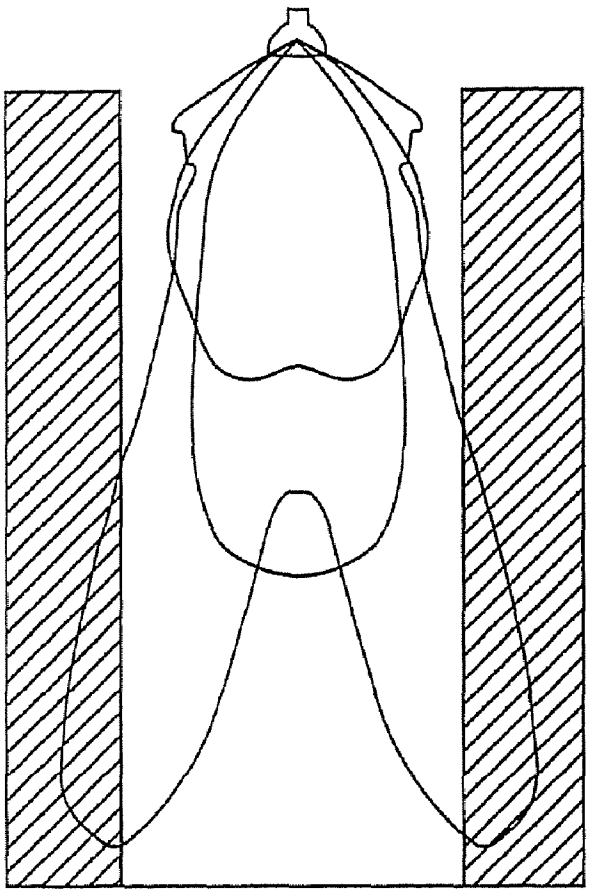
FIG. 12A shows FIGS. 11, 12, and 11A overlaid and scaled using a source with the same lumen output for all three.
Figure 11A:
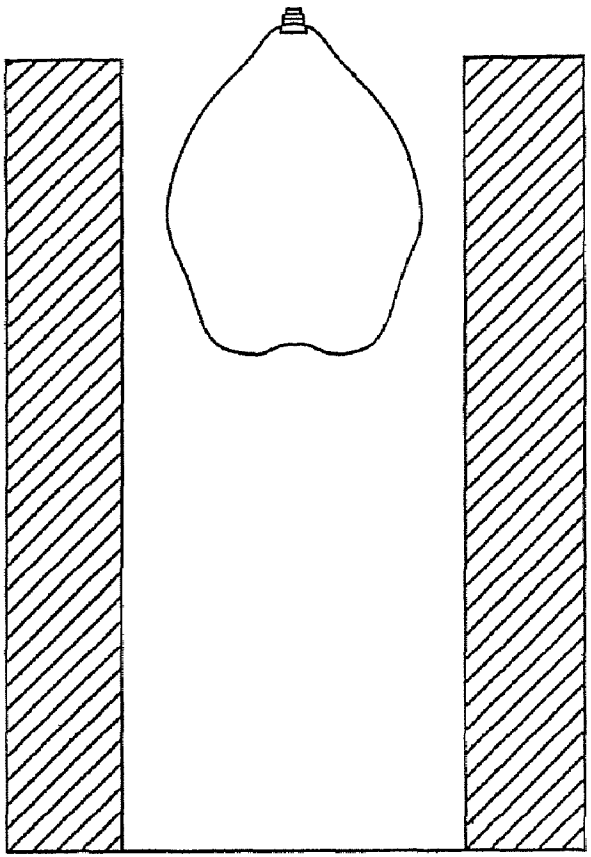
FIG. 11A PRIOR ART
FIG. 11A is a candlepower distribution curve (polar plot) of a prior art luminaire.

Directing light from a luminaire in a precise way to evenly light a surface while maximizing candlepower presents a challenge as shown by the luminaire 2 of Prior Art FIG. 11. A good example is lighting book stacks or shelves 4 in libraries and media centers where the aisles are typically 32", 42", and 48" wide and 84" to 96" high. This high and narrow space requires a specific photometric distribution to evenly illuminate the media or bookshelves from top to bottom while not wasting light by sending it incident onto the floor rather than to the book shelves 4. Also, due to the geometry of the space, linear fluorescent luminaires are most often used to illuminate the vertical surfaces down the length of the aisles.

Additionally, The Illuminating Engineering Society of North America (IESNA) recommends a minimum illuminance level of 30 vertical foot-candles on a book stack at 30 inches above the finished floor 5. Many existing luminaires used for this application employ high wattage fluorescent lamps or multiple lamps in cross-section (side-by-side) to achieve the recommended light level. The resulting connected power load (in watts) or lighting power density ("LPD"—in watts per square foot) does not comply with the applicable energy code requirements.

For example, ANSI/ASHRAE/IESNA have jointly published an "ASHRAE Energy Standard" which many local states have adopted or incorporated into their building codes. California has established a more stringent energy code known as "Title 24". These standards specify the maximum allowable LPD for various areas within a building. The current ASHRAE LPD allowance for library stacks is 1.7 watts/sq.ft. The current California Title 24 LPD allowance for library stacks is 1.5 watts/sq.ft.

Working backwards, the maximum allowable wattage lamp to comply with these LPD allowances can be calculated. For example: a 36" wide aisle with 12" deep book stacks on either side of the aisle for a length of 4 feet represents a 20 square foot area. Based on the ASHRAE standard of 1.7 watts per square foot the maximum allowable connected load for a fixture used in this space must not exceed 34 watts (derived from 1.7 W/SqFt×20 SqFt). Based on California Title 24 the connected load cannot exceed 30 watts (1.5 W/SqFt×20 SqFt).

Thus, it would be advantageous to have a luminaire available, which would not only comply with the energy code requirements, but also provide the IESNA recommended light levels. In addition to meeting the energy and illuminance targets, it is desirable that luminaires be designed to minimize discomforting glare from normal viewing angles as well as be of minimal size.

Figure 1A:
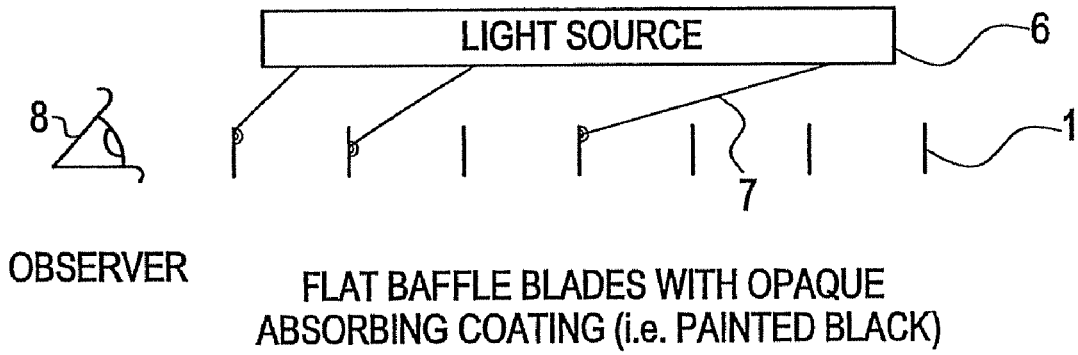
FIG. 1A PRIOR ART
FIG. 1*a* is a prior art baffle which blocks the view of the light source by absorbing light.
Figure 1B:
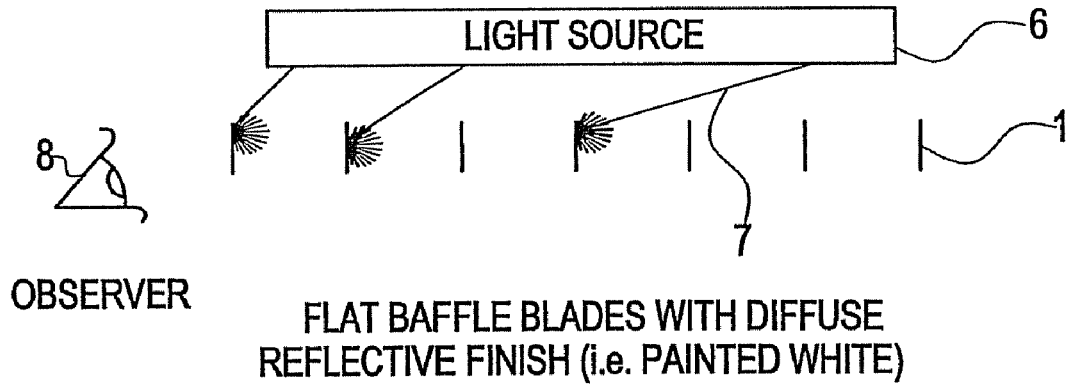
FIG. 1B PRIOR ART
FIG. 1*b* is a prior art baffle which blocks the view of the light source by dispersing light.
Figure 1C:
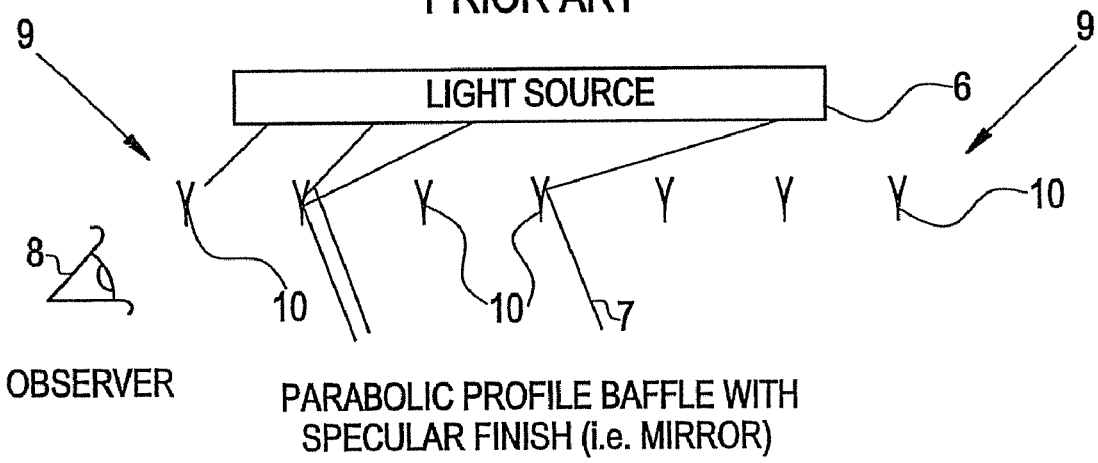
FIG. 1C PRIOR ART
FIG. 1*c* is a prior art baffle which blocks the view of the light source by redirecting light.
Figure 1D:
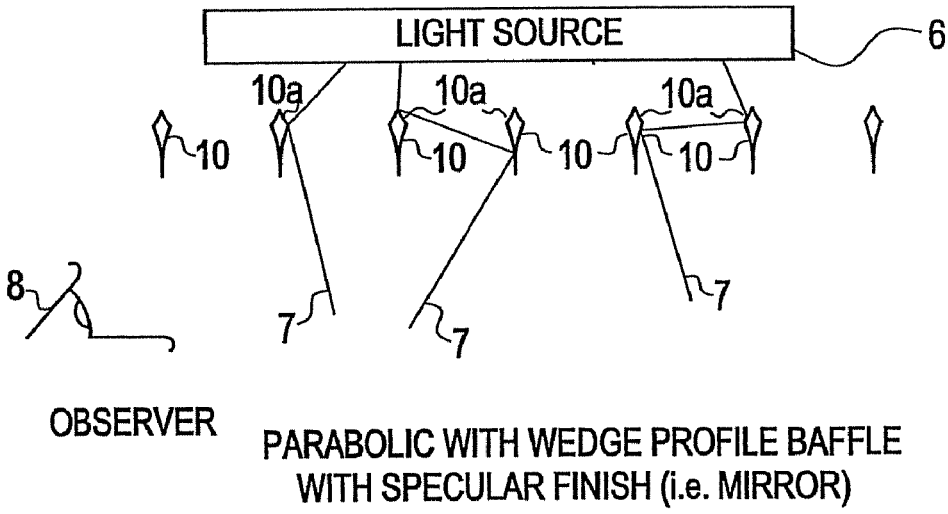
FIG. 1D PRIOR ART
FIG. 1*d* is a prior art baffle which has a wedge profile.
Figure 2:
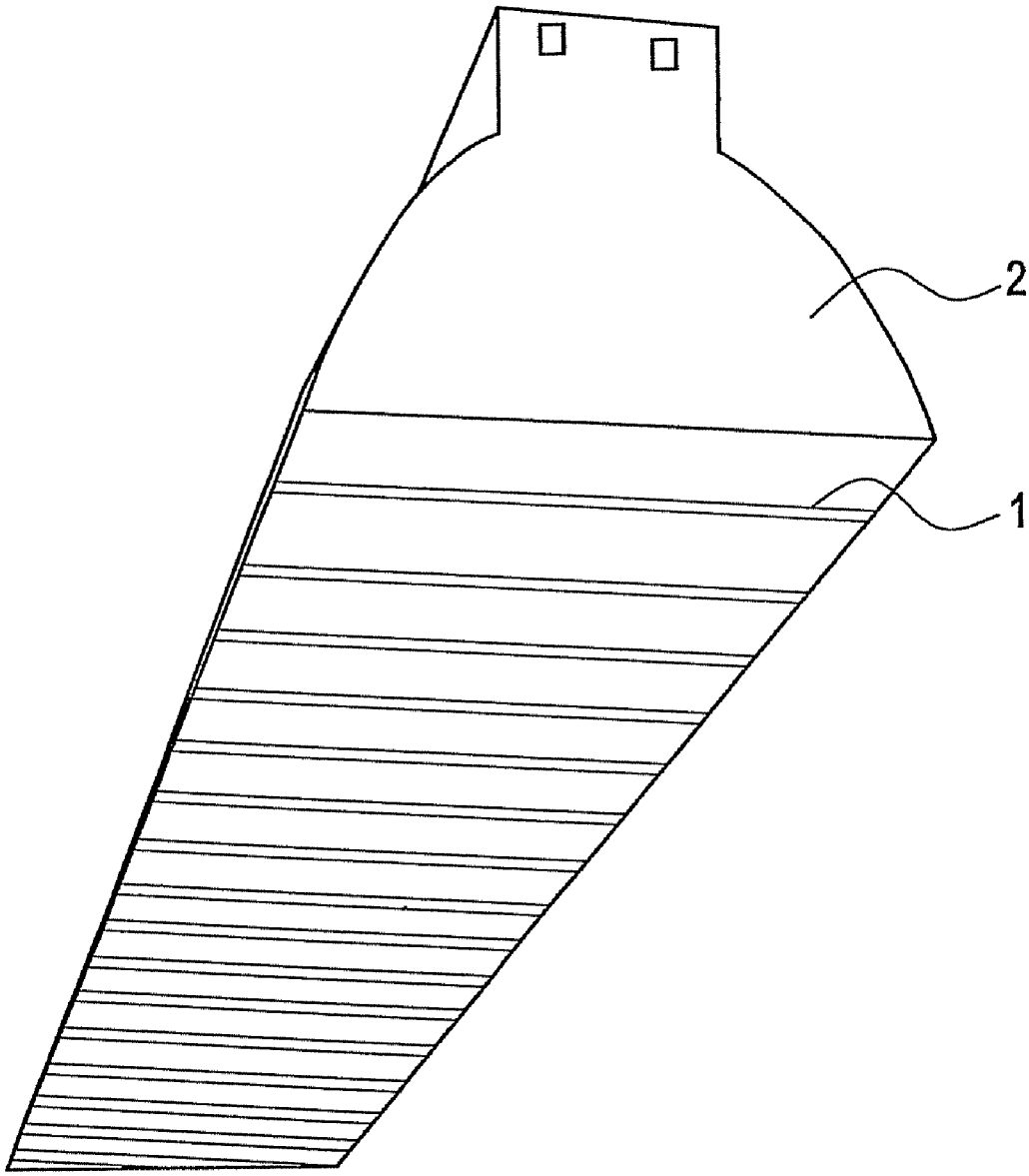
FIG. 2 PRIOR ART
FIG. 2 is a prior art luminaire with a prior art baffle.

As shown in Prior Art FIG. 2, stack light luminares 2 typically employ baffle blades 1 to reduce discomforting glare. The baffle blades 1 used in the FIG. 2 luminaire consist of an array of uniform shaped baffle blades 1 located at the bottom aperture of the luminaire 2 to shield the lamp light source 6 and to reduce unwanted brightness when viewed from below, for example, when looking down the length of the aisle. As shown in FIG. 1*d*, in the prior art device, any upper edges 10*a* of the side 10 of baffle blade 1 located closest to the light source 6 are flattened edges (see FIG. 1*d*) or are partially open or "hollowed out" (not shown) due to fabrication or cost considerations. Light which hits any upper edges 10*a* of the sides 10 of the baffle blades 1 is minimal because the area is small in size, and the light is either partially absorbed and/or partially scattered. Thus, this light incident upon the upper edges 10*a* of side 10 is not used effectively for lighting.

Therefore, what is desired is a luminaire with an improved and novel baffle that may light both vertical sides of a selected space such as an aisle or any narrow corridor (library stacks, archives, retail store aisles, etc.) evenly from top to bottom in an efficient manner. For example, it would be desirable for the efficiency gained to help a user meet the energy code requirements, and to meet the IESNA recommended light levels discussed above in detail. In order to accomplish this, the present invention "harvests" the light which hits the top sections of the baffles and uses this otherwise wasted light to augment the resultant light distribution and to increase output without requiring a larger, less efficient, bulb for example. Reusing this otherwise scattered or wasted light also helps minimize unwanted spill light incident upon the floor and helps minimize unwanted and discomforting glare while achieving high luminaire efficiency while minimizing mass. Additionally, beneficial considerations also include appearance and cost.

The present invention may meet the above needs in several ways. Additionally, the description below is not intended to be limited to only one specific embodiment.

Figure 3:
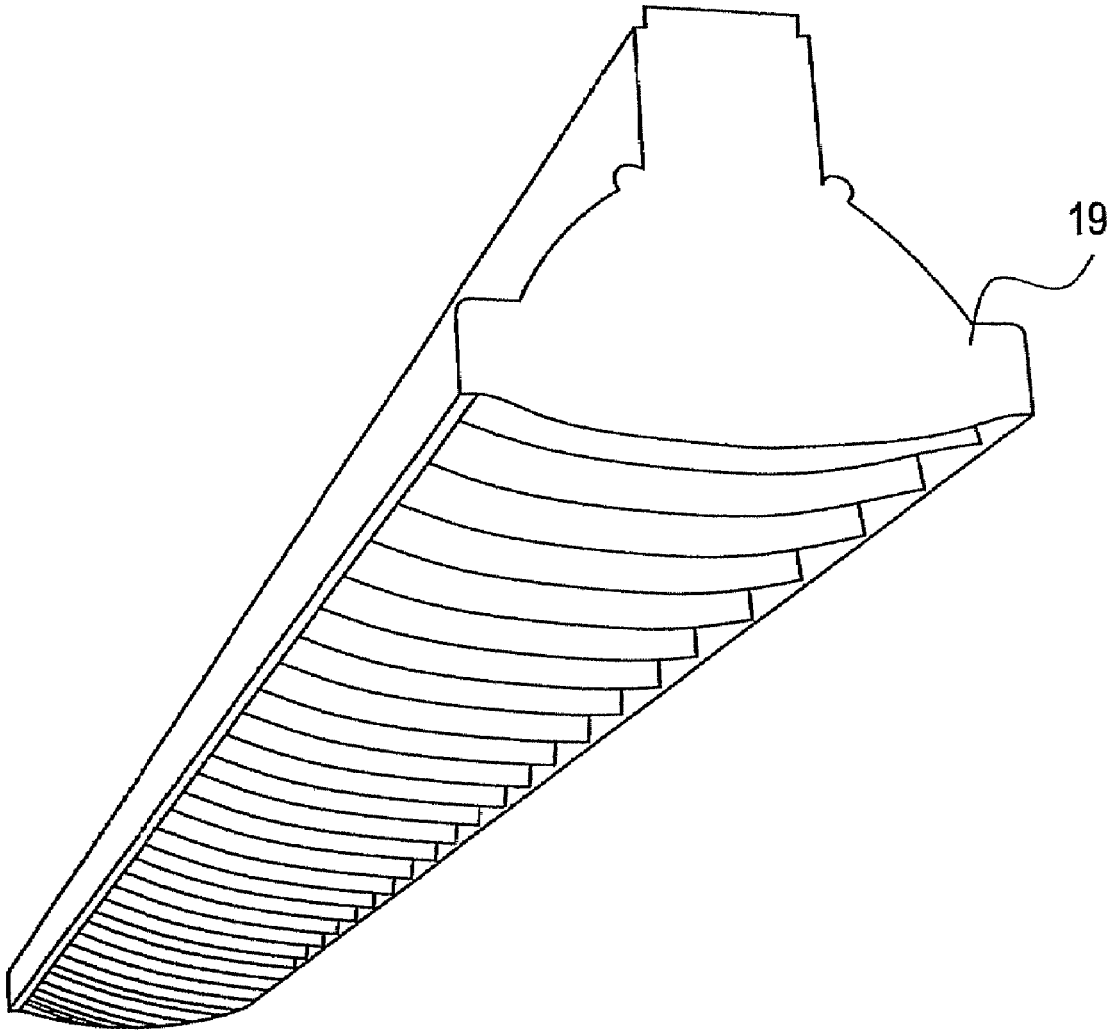
FIG. 3 is a perspective view of a luminiare with an exemplary embodiment of the baffle of the invention.
Figure 12:
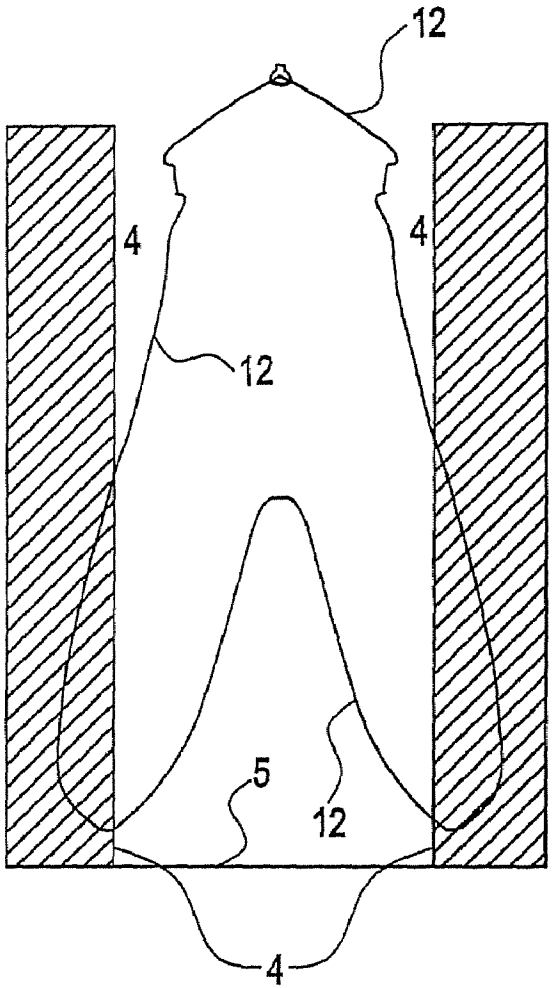
FIG. 12 is a candlepower "two-wing" distribution curve (polar plot) of a luminaire using an exemplary embodiment of the baffle of the invention. In this example the baffle blades are wider under the lamp to re-use the light that would otherwise be directed or "spilled" onto the floor and to redirect that light to the target surfaces (vertical shelving). The blades are narrower at the sides to allow direct light from the source to reach the vertical shelving.

FIG. 3 shows an example of an embodiment of a directional luminaire 19 which produces the resultant improved "directional" light distribution 12 as shown in FIG. 12 by making use of a novel reflective top surface baffle blade concept. From the shape of the directional light distribution 12, it can be understood that the vertically orientated surfaces of the shelves 4 are "directionally" illuminated evenly from near the floor to near the uppermost sections of the shelves 4. As noted above, this directional light distribution 12, is an improved design over typical prior art luminaire 2 design, because it maximizes light 11*a* directed to the vertical surfaces by not wasting useable light by use of novel baffles blades having reflective top surfaces, so that resultant light output can be maximized without resorting to use of more powerful light sources requiring more energy.

Figure 9:
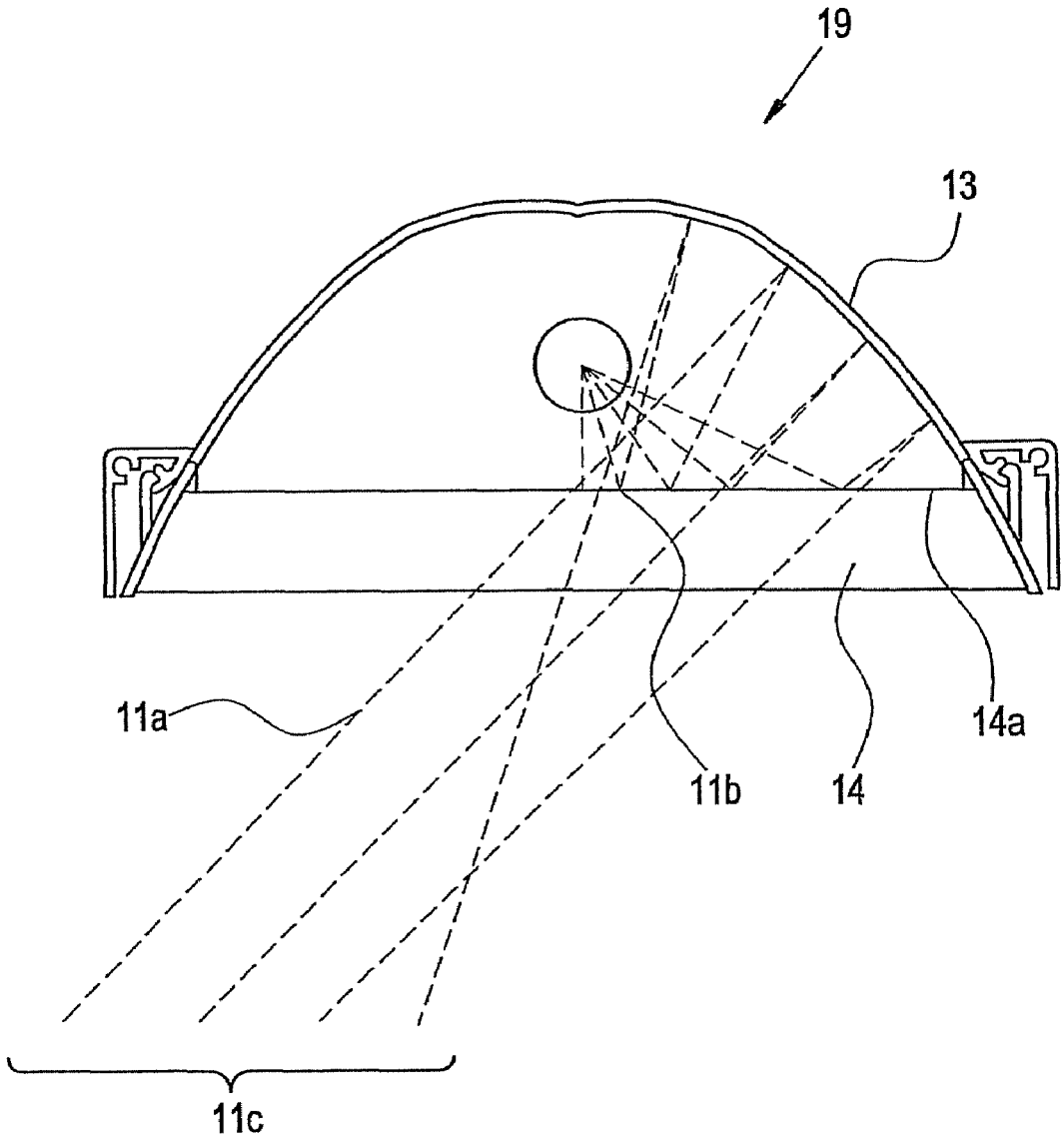
FIG. 9 shows a section through a luminaire fitted with a flat/horizontal profile baffle of an embodiment.
Figure 10:
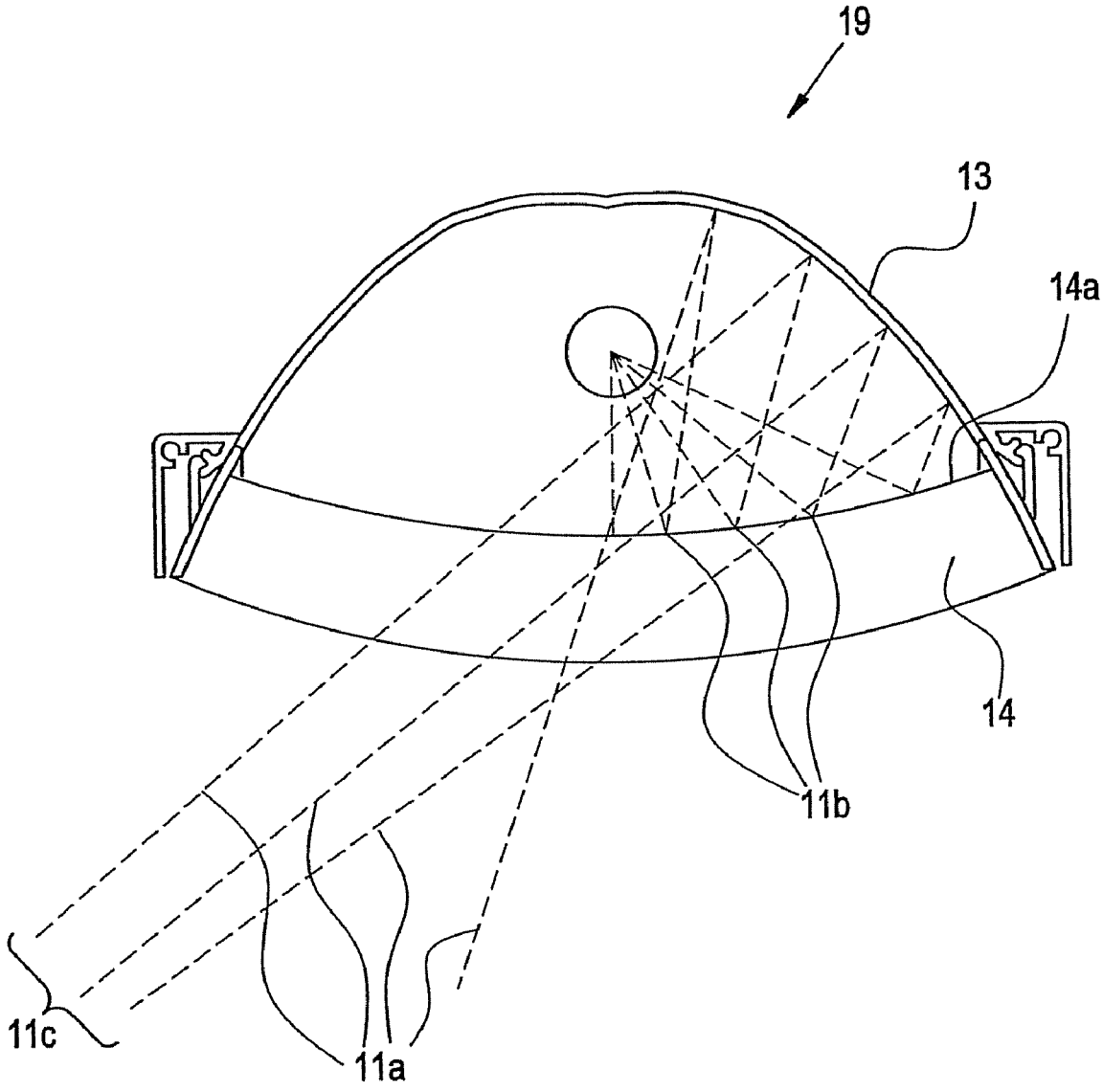
FIG. 10 shows a section through a luminaire fitted with a elliptically shaped profile baffle of an embodiment.

For example, it can be seen from the shape of the directional light distribution 12 in FIG. 12, in comparison to the prior art light distribution 3 in FIG. 11, that light that would otherwise be sent towards the floor is redirected to evenly illuminate the surfaces of the book shelf or shelves 4 in an aisle in a store for example from top to bottom. In this example, this directional control of the light distribution 12 is enabled in part by directional reflector 13 working in conjunction with the novel reflective top sections baffle blades 4 as shown in the embodiments of FIGS. 9 and 10 by the path of propagating light rays 11*a*, 11*b*, and 11*c*. Specifically, as seen in FIGS. 9 and 10, the tops of the baffle blades comprise horizontally orientated reflective top sections 14*a* of the reflective baffle blades 14 which are designed to redirect light back to the directional reflector 13 or other device in order to redirect light 11*a* (see reflection points 11*b*) back into the resultant output beam 11*c* to light the target surfaces more evenly with improved and maximized output without necessitating use of a larger more energy inefficient bulb for example. Thus, it is possible to increase the resultant output candlepower by using novel baffle blade 4 having reflective top sections 14*a*.

Six specific and representative embodiments will be discussed below in detail. However, this disclosure is not intended to be interpreted to be limited to only these specific examples as variations and equivalents thereof are envisioned and intended to be covered herein by the attached claims and would be apparent to those skilled in the art.

Figure 4A:
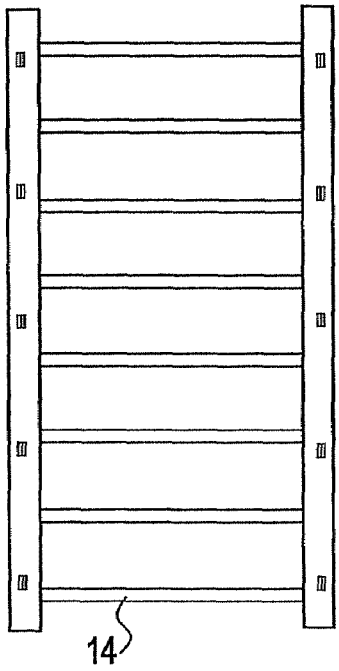
FIGS. 4*a*-4*d* show top, front, side and isometric views of an embodiment of the invention with an array of uniform baffle blades with reflective top sections.
Figure 4B:
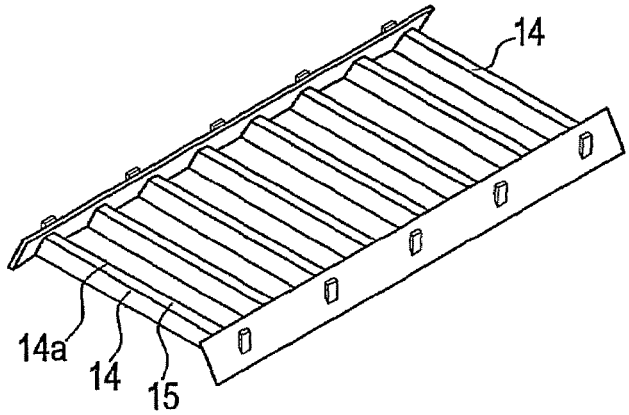
Figure 4C:
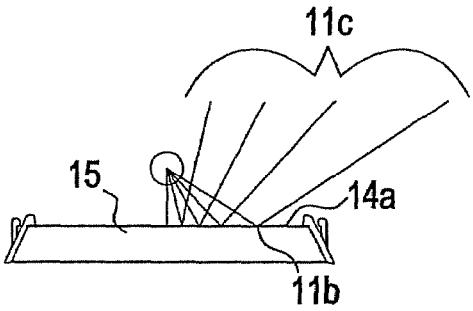
Figure 4D:
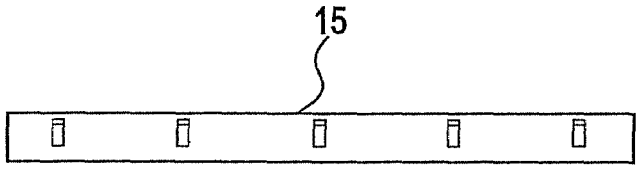

First as shown in FIGS. 4*a*-4*d*, an embodiment may comprise a reflective baffle blade 14 for use with a luminaire comprising a blade member having a uniform width and a reflective top section 14*a* which in this case is a horizontally orientated flat reflective surface 15 that is structured so that light is reflected in a desired direction as shown in FIG. 4*c* for example.

Figure 5A:
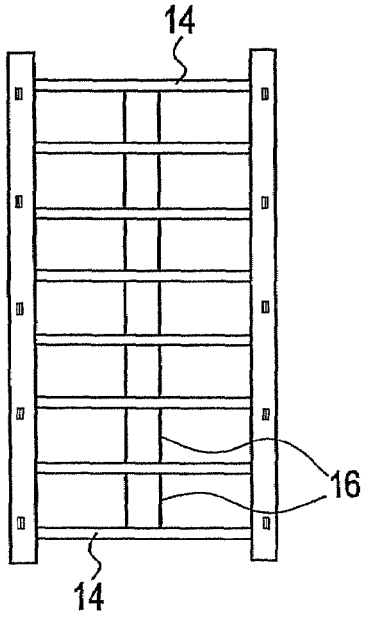
FIGS. 5*a*-5*d* show top, front, side and isometric views of an embodiment of the invention with an array of uniform baffle blades with reflective top sections and an additional reflective strip under the light source.
Figure 5B:
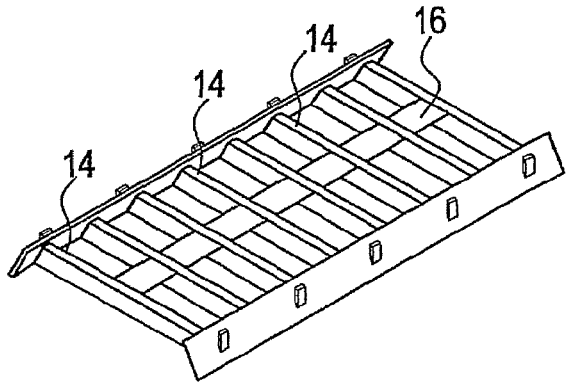
Figure 5C:
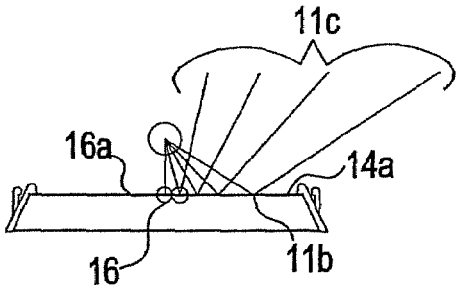
Figure 5D:
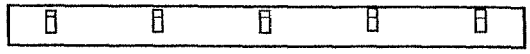

Second, another embodiment is shown in FIGS. 5*a*-5*d* wherein an additional reflective strip 16 is added to an array of reflective baffle blades 14. These reflective baffle blades 14 are of the same shape and as the reflective baffle blades shown in FIGS. 4*a*-4*d*. This additional reflective strip 16 provides additional reflected light as shown in FIG. 5*c* by reflection point 16*a* which is propagated to become a component of resultant output beam 11*c*. In this embodiment the reflective strip 16 is located under the source, for example parallel to the light source, to minimize light directed downward.

Figure 6A:
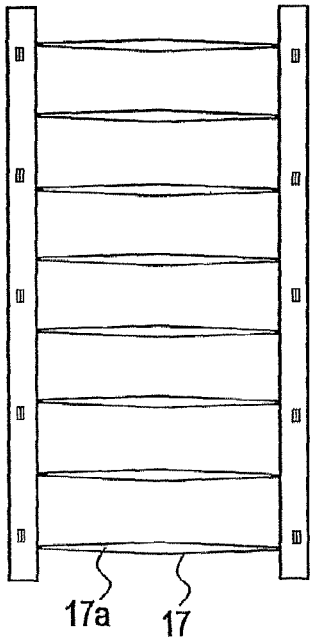
FIGS. 6*a*-6*d* show top, front, side and isometric views of an embodiment of the invention with an array of variable width baffle blades (widest under the light source) with reflective top sections.
Figure 6B:
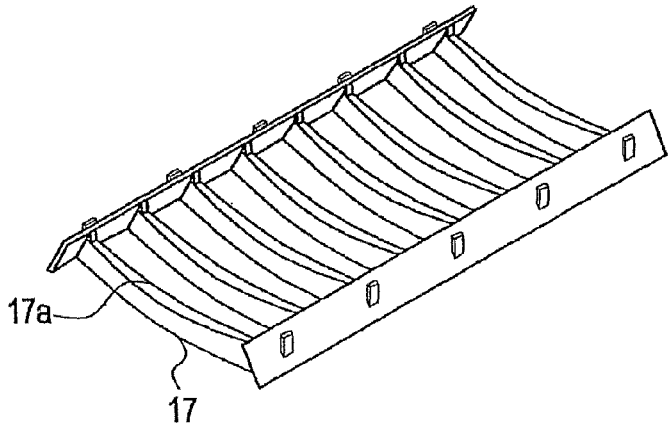
Figure 6C:
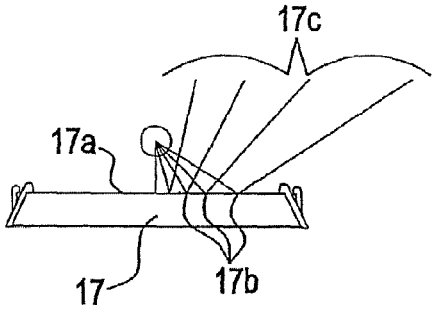
Figure 6D:
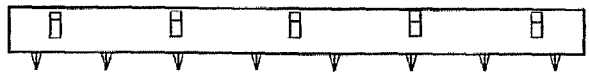

Third, another embodiment is shown in FIGS. 6*a*-6*d* wherein a variable width reflective baffle blade 17 for a luminaire comprises a blade member having a variable width as shown in FIG. 6*a* and a reflective top section 17*a*. The reflective top section 17*a* has a curved, elliptical, or custom shaped surface wherein the surface is structured so that light is reflected (see reflection points 17*b* to become part of resultant beam 17*c* as shown in FIG. 6*c*. In this embodiment, the variable width baffle blades 17 are widest under the light source to minimize light directed downward directly beneath the light source 6. It is important to note that these blades may also be made of uniform width depending upon the required application.

Figure 7A:
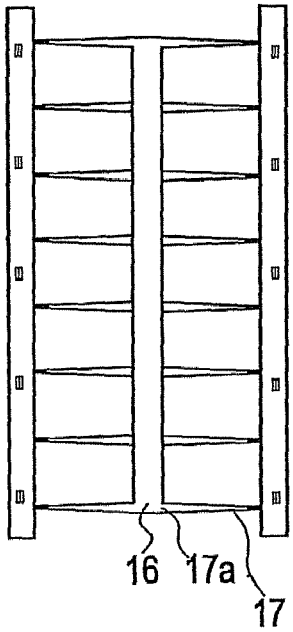
FIGS. 7*a*-7*d* show top, front, side and isometric views of an embodiment of the invention with an array of variable width baffle blades (widest under the light source) with reflective top sections and an additional reflective strip located under the light source.
Figure 7B:
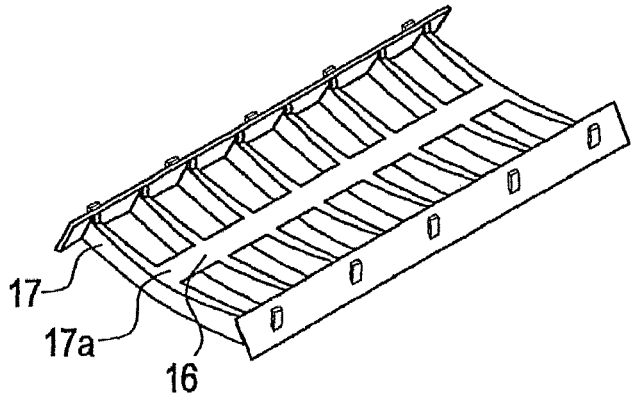
Figure 7C:
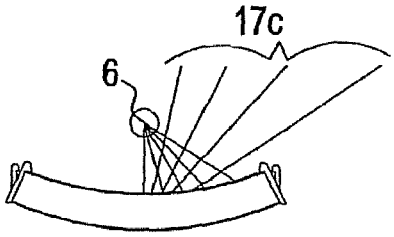
Figure 7D:
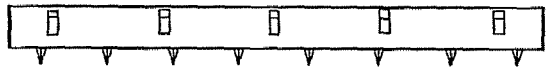
Figure 8A:
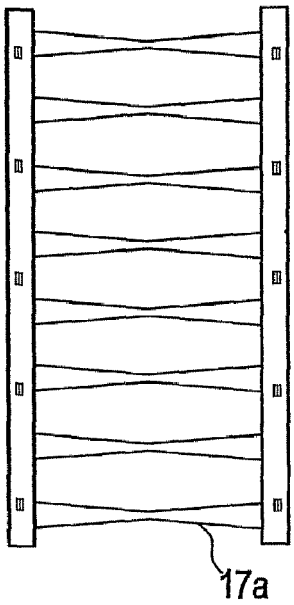
FIGS. 8*a*-8*d* shows top, front, side and isometric views of an embodiment of the invention with an array of variable width baffle blades (narrowest under the light source) with reflective top sections.
Figure 8B:
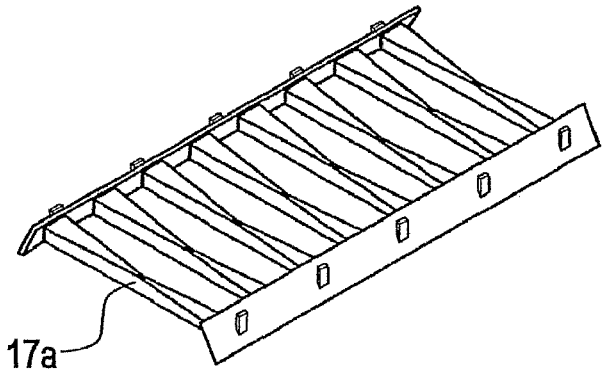
Figure 8C:
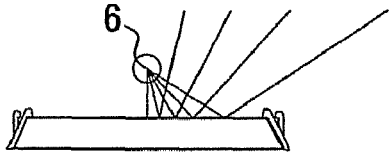
Figure 8D:
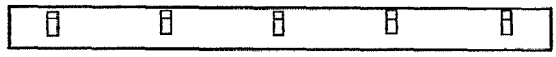

Fourth, another embodiment of the invention is shown in FIGS. 7*a*-7*d* which is the same as the embodiment discussed above in reference to FIGS. 6*a*-6*d* except for an additional longitudinal reflective strip 16 that is arranged perpendicular to the variable width baffle blades 17. The reflective top section 17*a* of the baffle blades 17, and the reflective strip 16 are structured so that light is reflected to become part of resultant beam 17*c* as shown in FIG. 7*c*. In this embodiment, the reflective strip 16 is located under the light source 6 and the variable width baffle blades 17 are widest under the light source 6 to minimize light directed downward directly beneath the light source 6.

Fifth, another embodiment of the invention is shown in FIGS. 8*a*-8*d*. In this embodiment the variable width baffle blades 17 are made narrow under the light source 6 to maximize light directed directly downward from the light source 6.

Figure 13A:
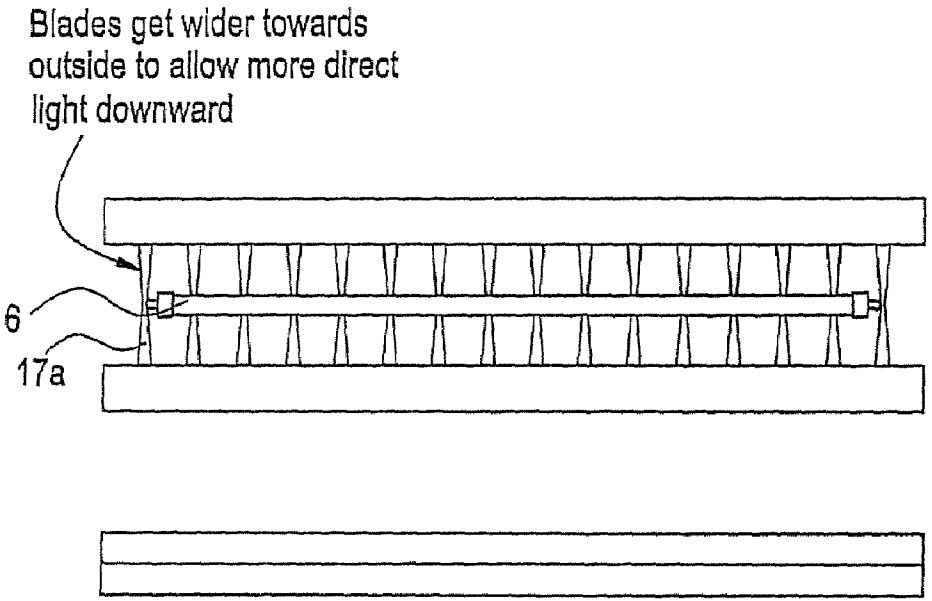
FIG. 13*a* is a luminaire of another embodiment of the invention wherein the baffle blades are narrower under the light source and wider to the sides. In this example it is desirable to allow direct light from the source to pass (toward nadir) and reflect light at the edges off of the top surfaces of the baffle in an upward direction.
Figure 13B:
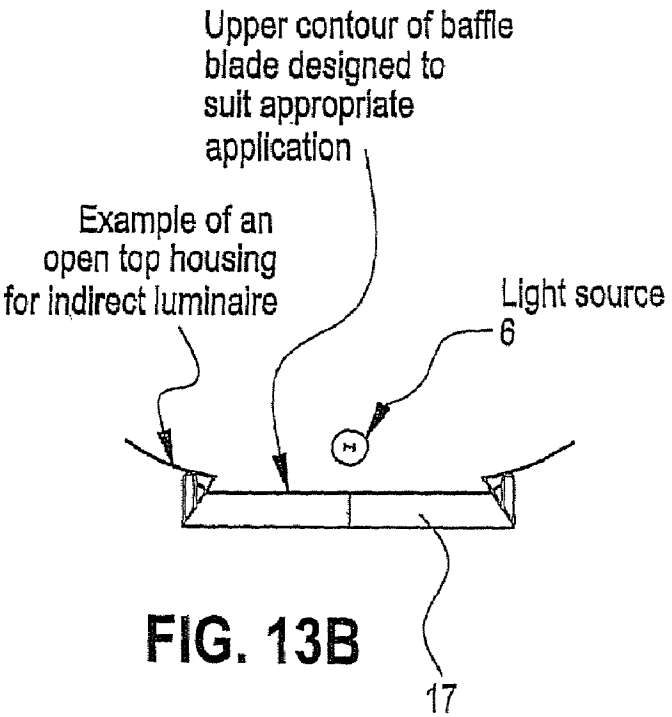
FIG. 13*b* is a cross-sectional view of the luminaire in FIG. 13*a*.

Sixth, another embodiment of the invention is shown in FIG. 13. This is an example of an open top luminaire application. In this embodiment, the variable width baffle blades 17 are made narrow under the light source 6 to maximize light directed directly downward from the light source 6. Therefore, this illustrates that a directional reflector 13 is not always required and thus is not essential to the novel concept or invention as a whole, but may be used depending upon the application requirements. This embodiment also allows control over light projected upward to light a ceiling for example.

Thus, as the embodiments above demonstrate, many configurations of the invention are possible depending upon the required application. Thus, it is not required herein to provide a design specification or an exhaustive list of all possible custom applications which could use the overall novel reflective baffle blades having reflective top sections of the present invention. However, a partial list includes illumination of book shelves or book stacks, aisles including aisles located in stores, and illumination of any opposing vertical surfaces in general.

It is also noted that the entire top surface of the variable width baffle blade may act as a useful reflector and not merely at the widest part. In contrast, most prior art luminaires of this type have a top surface that is not reflective and that is hollowed out. Thus, as discussed above, the top surface of the present embodiment baffle may have a specifically shaped contour and width which may be, but is no limited to an elliptical shape, and which becomes wider directly under the lamp to harvest and re-use the lamp energy that would otherwise go directly to the floor and put it back into the main beam which lights the vertical desired surface more evenly as shown in FIG. 12. Alternatively, the blades could become wider at the sides to allow more light directly to the floor, or may be an even width if so desired.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention.

The invention claimed is:

1. A baffle blade for a luminaire comprising:

a blade member comprising:

a reflective top section; and at least one side;

wherein the blade member is defined by a blade member height, a blade member width, and a blade member length, the blade member height extending generally from an upper edge of the blade member proximate to the reflective top section to an opposite lower edge, the blade member height being substantially consistent across a substantial entirety of the blade member length;

wherein the reflective top section has a reflective surface that has a substantially horizontal orientation in the luminaire; and wherein the sides of the blade member have a substantially vertical orientation in the luminaire; and wherein the reflective top section is structured so that light is directed from the reflective top section to a predetermined location.

2. The baffle blade of claim 1 wherein the top section is a substantially flat surface.

3. The baffle blade of claim 1 wherein the top section is specular.

4. The baffle blade of claim 1 wherein the blade member has an shaped top section profile.

5. The baffle blade of claim 1 wherein the blade member has a variable width.

6. The baffle blade of claim 5 wherein the blade member has a variable width with a narrower width located towards its ends than it has towards its center.

7. The baffle blade of claim 5 wherein the blade member has a variable width with a wider width located towards its ends than it has towards its center.

8. The baffle blade of claim 1 wherein the blade member has one width for the entire width of the baffle blade.

9. The baffle blade of claim 1 further comprising an additional reflective section.

10. A luminaire comprising:

a reflector;

at least one baffle blade, wherein the baffle blade is defined by a blade height, a blade width, and a blade length, the blade member height extending generally from an upper edge of the blade member proximate to the reflective top section to an opposite lower edge, the blade height being substantially consistent across a substantial entirety of the blade length; and a reflective top section included with the baffle blade;

wherein the reflective top section is structured so that light is reflected from the reflective top section to the reflector in order to redirect light towards a predetermined direction and to increase light output of the luminaire in a specific direction.

11. The luminaire of claim 10 further comprising an additional reflective section located between a plurality of the baffle blades.

12. The luminaire of claim 10 wherein the top section is a substantially flat surface.

13. The luminaire of claim 10 wherein the top section is specular.

14. The luminaire of claim 10 wherein the baffle blade has a shaped top section profile.

15. The luminaire of claim 10 wherein the baffle blade has a variable width.

16. The luminaire of claim 10 wherein the baffle blade has a variable width with a narrower width located towards its ends than it has towards its center.

17. The luminaire of claim 10 wherein the baffle blade has a variable width with a wider width located towards its ends than it has towards its center.

18. The luminaire of claim 10 wherein the baffle blade has one width for the entire width of the baffle blade.

19. The luminaire of claim 10 further comprising an additional reflective section.

20. A lighting system comprising:

a luminaire disposed in proximity to at least one vertical surface, the luminaire including:

a lamp, a reflector, at least one baffle blade having a reflective top section;

wherein the reflective top section of the baffle blade is structured and disposed to receive light emanating directly from the lamp and to redirect the light to the reflector which is structured to reflect the light to the at least one vertical surface.

21. The lighting system of claim 20, wherein the baffle blade is disposed beneath the lamp and the vertical surface is disposed below the luminaire.

22. The lighting system of claim 21, wherein the reflector is disposed at a side of the lamp in a disposition generally perpendicular to the baffle blade and wherein the reflector is structured to receive the light emanating directly from the lamp and to reflect the light to the vertical surface.

23. The lighting system of claim 22, wherein the reflective top section has a variable width across a length thereof, wherein the width is largest at a position disposed directly beneath the lamp.

24. The light system of claim 21, wherein the vertical surface comprises two vertical surfaces located opposite from one another, beneath the luminaire and equidistant from the luminaire, wherein the light reflected by the top section is initially directed from the lamp to an area between the two opposed vertical surfaces, such that the light is prevented from emanating to teh area and instead is redirected to the reflector and is reflected thereby to each of the vertical surfaces.

25. A method for lighting a vertical surface:

providing a luminaire including a reflector, a lamp, and at least one baffle blade having a reflective top section;

positioning the lamp relative to the top section such that light emanating directly from the lamp is received by the reflective top section;

directing the light from the reflective top section to the reflector;

re-directing the light from the reflector to the vertical surface; and lighting the vertical surface via the directing of the light.

26. The method of claim 25, wherein the vertical surface istwo vertical surfaces located opposite from one another, beneath the luminaire and equidistant from the luminaire, the method further including initially directing the light from the lamp to an area between the two opposed vertical surfaces, and preventing the light from emanating to the area via the reflective top section; and instead is redirecting the light to the reflector, which thereby again redirects the light to each of the vertical surfaces.

27. The method of claim 25, further including disposing the baffle blade beneath the lamp, and disposing the vertical surface below the luminaire.

28. The method of claim 27, further including disposing the reflector at a side of the lamp in a disposition generally perpendicular to the baffle blade, and structuring the reflector to receive the light emanating directly from the lamp and to reflect the light to the vertical surface.

29. The method of claim 28, further including providing the reflective top section with a variable width across a length thereof, wherein the width is largest at a position disposed directly beneath the lamp.

* * * * *